US008912975B1

(12) United States Patent
Hafenrichter et al.

(10) Patent No.: US 8,912,975 B1
(45) Date of Patent: Dec. 16, 2014

(54) REWORKING ARRAY STRUCTURES

(71) Applicants: Joseph L. Hafenrichter, Seattle, WA (US); Joseph A. Marshall, IV, Kent, WA (US); Jeffrey Lynn Duce, Milton, WA (US); Manny Salazar Urcia, Jr., Bellevue, WA (US); Otis Franklin Layton, Bonney Lake, WA (US); David L. Banks, Renton, WA (US)

(72) Inventors: Joseph L. Hafenrichter, Seattle, WA (US); Joseph A. Marshall, IV, Kent, WA (US); Jeffrey Lynn Duce, Milton, WA (US); Manny Salazar Urcia, Jr., Bellevue, WA (US); Otis Franklin Layton, Bonney Lake, WA (US); David L. Banks, Renton, WA (US)

(73) Assignee: The Boeing Company, Chicago, IL (US)

( * ) Notice: Subject to any disclaimer, the term of this patent is extended or adjusted under 35 U.S.C. 154(b) by 268 days.

(21) Appl. No.: 13/623,607

(22) Filed: Sep. 20, 2012

(51) Int. Cl.
*H01Q 21/00* (2006.01)

(52) U.S. Cl.
USPC ..... 343/893; 343/705; 343/798

(58) Field of Classification Search
USPC ..... 343/705, 797, 798, 893; 29/600
See application file for complete search history.

(56) References Cited

U.S. PATENT DOCUMENTS

| | | | | |
|---|---|---|---|---|
| 2,185,692 | A | 1/1940 | McCleary | |
| 3,388,016 | A | 6/1968 | Murray et al. | |
| 4,808,253 | A | 2/1989 | Mimbs | |
| 4,820,564 | A | 4/1989 | Cologna et al. | |
| 4,916,880 | A | 4/1990 | Westerman, Jr. | |
| 4,978,404 | A | 12/1990 | Westerman, Jr. | |
| 4,987,700 | A | 1/1991 | Westerman et al. | |
| 5,207,541 | A | 5/1993 | Westerman et al. | |
| 5,279,725 | A | 1/1994 | Westerman, Jr. | |
| 7,109,942 | B2 | 9/2006 | McCarville et al. | |
| 7,935,205 | B2 | 5/2011 | Bogue et al. | |
| 8,446,330 | B1 * | 5/2013 | McCarville et al. | 343/797 |
| 2010/0250148 | A1 | 9/2010 | Meredith et al. | |
| 2013/0229321 | A1 * | 9/2013 | McCarville et al. | 343/798 |

OTHER PUBLICATIONS

Armstrong et al., "Care and Repair of Advanced Composites," SAE International, 2nd ed., copyright 2005, 28 pages.

* cited by examiner

*Primary Examiner* — Tan Ho
(74) *Attorney, Agent, or Firm* — Yee & Associates, P.C.

(57) ABSTRACT

A method and apparatus for reworking an antenna aperture. A plurality of antenna cells comprise walls and antenna elements on the walls. Replacement antenna cells are placed adjacent to the plurality of antenna cells. The replacement antenna cells comprise a replacement wall and a replacement antenna element on the replacement wall. A conductive splice is attached to the replacement antenna element and to a one of the antenna elements on a one of the walls.

20 Claims, 10 Drawing Sheets

REWORKING ARRAY STRUCTURES

BACKGROUND INFORMATION

1. Field

The present disclosure relates generally to systems and methods for reworking antenna array structures and structures made of composite materials. More particularly, the present disclosure relates to methods for reworking antenna array structures to restore both radio frequency and structural performance of the antenna array and to antenna arrays that have been reworked using such methods.

2. Background

A phased array antenna includes a plurality of individual antenna elements. Phase shifters are used to adjust the signals transmitted by the individual antenna elements to produce a focused antenna beam that is steerable in a desired direction. Therefore, using a phased array antenna, the direction of a radio frequency signal transmitted from the antenna may be steered or scanned without physically moving the antenna. In a similar manner, the phased array antenna may be steered without physically moving the antenna so that the main beam of the antenna is in a desired direction for receiving a radio frequency signal. Steering a phased array antenna for transmitting and receiving a radio frequency signal in a desired direction enables directed communication in which a radio frequency signal is electronically focused in the desired direction.

Phased array antennas are used for a variety of applications. For example, without limitation, phased array antennas may be used for radar systems, communications systems, or other applications. Phased array antennas may be mounted for use on a variety of mobile platforms. For example, without limitation, phased array antennas may be mounted on aircraft, spacecraft, marine vehicles, and even land vehicles for transmitting and receiving electromagnetic signals.

Antenna array structures may be formed by a plurality of antenna elements assembled into a grid-like arrangement. Traditional antenna array structures are formed by mounting the individual antenna elements on a support structure made of aluminum or other metal components. One limitation of such traditional antenna array structures is the weight that is associated with components of the antenna that are not directly necessary for transmitting or receiving signals, such as aluminum or other metallic components on which the antenna elements are supported.

In one preferred form, an antenna aperture for a phased array antenna may comprise a core structure with walls formed from composite materials. Individual antenna elements may be supported on the composite walls to form the antenna aperture. Composite materials may be tough, lightweight materials, created by combining two or more dissimilar components. For example, a composite material may include fibers and resins. The fibers and resins may be combined and cured to form a composite material. In an antenna aperture formed of composite materials, there is no need for aluminum blocks or other metal components for supporting the antenna elements which would add significant weight to the overall antenna aperture. An antenna aperture formed of composite materials is especially well-suited for use with mobile platforms such as manned and unmanned aircraft, spacecraft, and other high-speed mobile platforms, where light weight, high structural strength and rigidity are particularly desirable. This type of antenna aperture also may form a structurally rigid, light weight composite structure that is suitable for use as a load bearing portion of a mobile platform.

Inconsistencies in the antenna aperture of a phased array antenna may affect the performance of the antenna in undesired ways. Such inconsistencies may be caused, for example, by debris or other objects striking the antenna aperture when the antenna aperture is mounted and in use on a mobile platform. In other cases, inconsistencies in an antenna aperture may occur during manufacturing, transportation, or storage of the antenna aperture.

One response to inconsistencies in an antenna aperture may be to replace the entire antenna aperture. However, an antenna aperture may be relatively expensive. Therefore, it may be desirable to rework an antenna aperture with inconsistencies to remove the inconsistencies and restore the performance of the antenna aperture. However, methods for reworking traditional antenna apertures with antenna elements mounted on a support structure made of metal components may not be able to be used to rework antenna apertures formed of composite materials.

Therefore, it would be desirable to have a method and apparatus that takes into account at least some of the issues discussed above, as well as possibly other issues.

SUMMARY

An illustrative embodiment of the present disclosure provides an apparatus comprising a plurality of antenna cells comprising walls and antenna elements on the walls. Replacement antenna cells are placed adjacent to the plurality of antenna cells. The replacement antenna cells comprise a replacement wall and a replacement antenna element on the replacement wall. A conductive splice is attached to the replacement antenna element and to a one of the antenna elements on a one of the walls.

Another illustrative embodiment of the present disclosure provides an apparatus comprising a plurality of antenna cells comprising walls and antenna elements on the walls. A first facesheet is attached to the walls on a first side of the plurality of antenna cells. Replacement antenna cells are placed adjacent to the plurality of antenna cells. The replacement antenna cells comprise a replacement wall and a replacement antenna element on the replacement wall. A structural splice is attached to the replacement wall and to a one of the walls of the plurality of antenna cells. A conductive splice is attached to the replacement antenna element and to a one of the antenna elements on the one of the walls. A shape of the conductive splice matches a shape of a portion of the replacement antenna element and a shape of a portion of the one of the antenna elements on the one of the walls. A replacement facesheet is attached to the first facesheet and to the replacement wall on a first side of the replacement antenna cells. A second facesheet is attached to the walls on a second side of the plurality of antenna cells and to the replacement wall on a second side of the replacement antenna cells.

Another illustrative embodiment of the present disclosure provides a method for reworking an antenna aperture. Antenna cells are removed from the antenna aperture. The antenna cells comprise walls and antenna elements on the walls. Replacement antenna cells are placed in the antenna aperture in an area from which the antenna cells were removed. The replacement antenna cells comprise a replacement wall and a replacement antenna element on the replacement wall. A conductive splice is placed to connect the replacement antenna element to a one of the antenna elements on a one of the walls.

The features, functions, and benefits may be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives, and benefits thereof will best be understood by reference to the following detailed description of an illustrative embodiment of the present disclosure when read in conjunction with the accompanying drawings, wherein:

DETAILED DESCRIPTION

The different illustrative embodiments recognize and take into account a number of different considerations. "A number", as used herein with reference to items, means one or more items. For example, "a number of different considerations" are one or more different considerations.

The different illustrative embodiments recognize and take into account that there are currently no defined processes for reworking antenna array structures formed of composite materials in a manner that fully restores both radio frequency performance and structural performance. Operators of aircraft and other vehicles that may use such antenna array structures therefore currently may not be able to rework an antenna aperture formed of composite materials when the antenna aperture structure incurs an inconsistency while in service.

The different illustrative embodiments also recognize and take into account that an antenna array structure formed of composite materials may incur an inconsistency during manufacturing. Currently, there may be no economical way to rework an antenna aperture formed of composite materials that may incur such an inconsistency during manufacturing.

The different illustrative embodiments recognize and take into account that currently, the typical response to an inconsistency in an antenna aperture structure formed of composite materials is to scrap the entire antenna aperture having the inconsistency. Regardless of the cause of the inconsistency, an expensive component of a phased array antenna may be scrapped.

Illustrative embodiments therefore provide a method for reworking an antenna array structure made of composite materials in a manner that fully restores both radio frequency performance and structural performance of the array. In accordance with an illustrative embodiment, an antenna aperture may include a plurality of antenna cells comprising walls and antenna elements on the walls. A portion of the antenna aperture having an inconsistency may be removed by cutting out and removing some of the walls forming the cells in the antenna aperture. Replacement antenna cells may be placed in the antenna aperture in the area from which the walls were removed. The replacement antenna cells may include replacement walls with replacement antenna elements on the replacement walls. Structural splices may be used to attach the replacement walls to the remaining original walls of the antenna aperture. Conductive splices may be used to connect the replacement antenna elements to the remaining original antenna elements of the antenna aperture.

Figure 1:
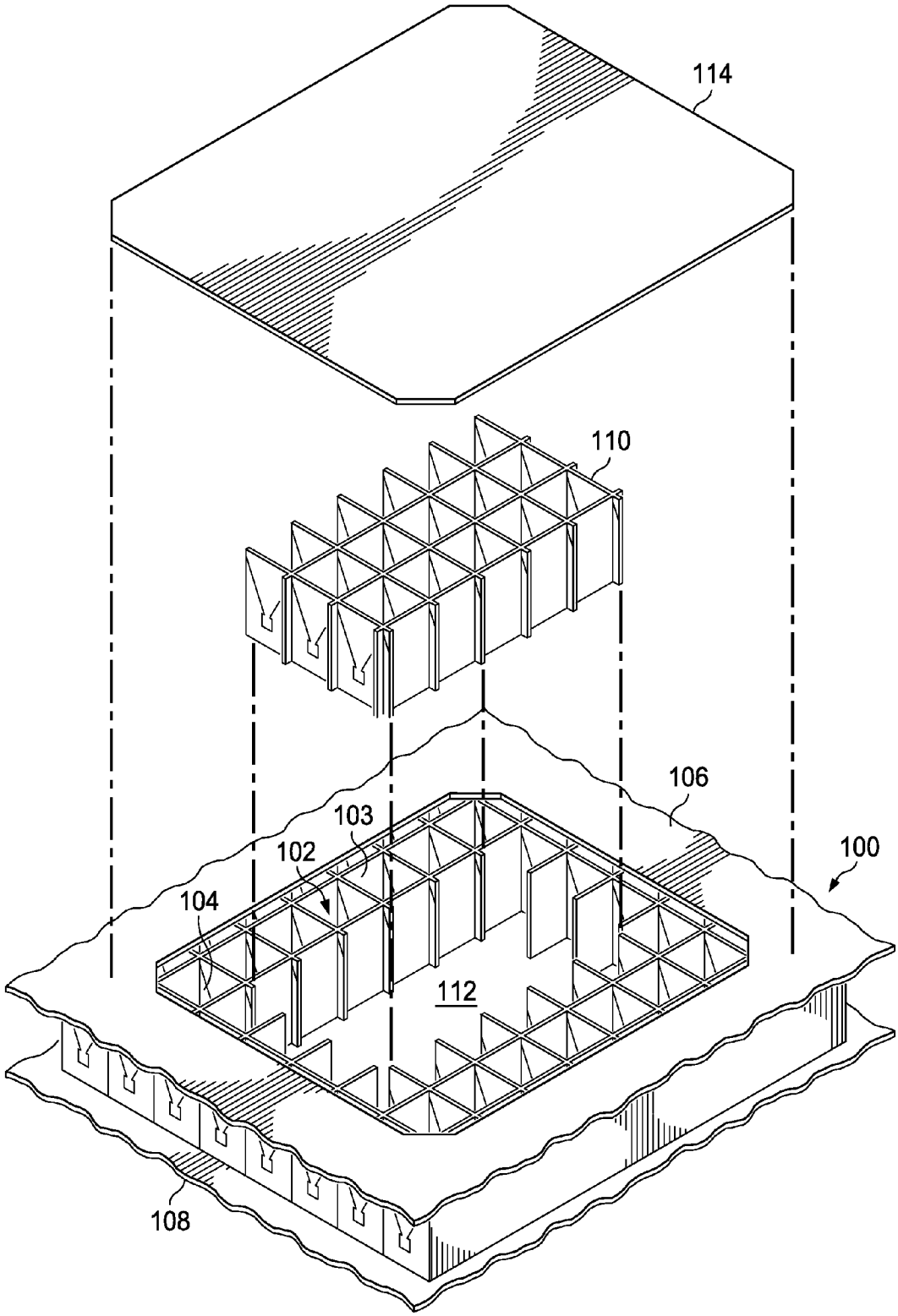
FIG. 1 is an illustration of an antenna aperture in accordance with an illustrative embodiment.

Turning now to FIG. 1, an illustration of an antenna aperture is depicted in accordance with an illustrative embodiment. Antenna aperture 100 may be used in a phased array antenna or other application. Antenna aperture 100 is well suited for use on aircraft or other mobile platforms where light weight and high structural strength are desired. Antenna aperture 100 is suitable for use as a load bearing component on a mobile platform. For example, without limitation, antenna aperture 100 may be integrated into an airframe for use as a skin panel on a fuselage, wing, door, or other portion of an aircraft or spacecraft.

Antenna aperture 100 includes antenna cells 102 formed in a grid-like structure. Antenna cells 102 are defined by walls 103 and include antenna elements 104 on walls 103. In this example, each of antenna cells 102 has four walls 103, with each of walls 103 including one of antenna elements 104, thereon. In other cases, antenna cells 102 may be formed in different shapes with different numbers of walls 103 and antenna elements 104. For example, in other cases, antenna cells 102 may not have antenna elements 104 on each of walls 103 forming antenna cells 102.

In accordance with an illustrative embodiment, walls 103 of antenna cells 102 may be formed of composite materials. For example, without limitation, walls 103 may be formed of a composite material including fibers and resins. The fibers and resins may be combined and cured to form walls 103. Antenna aperture 100 may be formed of such composite materials with a high degree of dimensional precision and tolerance for spacing antenna elements 104 as desired for various phased array antenna applications.

Antenna aperture 100 may include facesheets or other structures to enclose antenna cells 102. Such facesheets or other structures also may be made of composite materials. For example, first facesheet 106 may be attached to a first side of antenna cells 102. Second facesheet 108 may be attached to a second side of antenna cells 102. In this case, antenna cells 102 are sandwiched between first facesheet 106 and second facesheet 108.

Antenna aperture 100 may incur various inconsistencies. In accordance with an illustrative embodiment, antenna aperture 100 may be reworked to remove such inconsistencies and to restore the radio frequency and structural performance of antenna aperture 100.

For example, in accordance with an illustrative embodiment, a portion of first facesheet 106 and a number of antenna cells 102 affected by inconsistencies may be removed from antenna aperture 100. Replacement antenna cells 110 may be placed in antenna aperture 100 in area 112 from which antenna cells 102 were removed. Replacement antenna cells 110 may be structurally and electronically attached to antenna cells 102 remaining in antenna aperture 100 to restore the radio frequency and structural performance of antenna aperture 100. Replacement facesheet 114 may be attached to antenna aperture 100 to replace the portion of first facesheet 106 that was removed.

Figure 2:
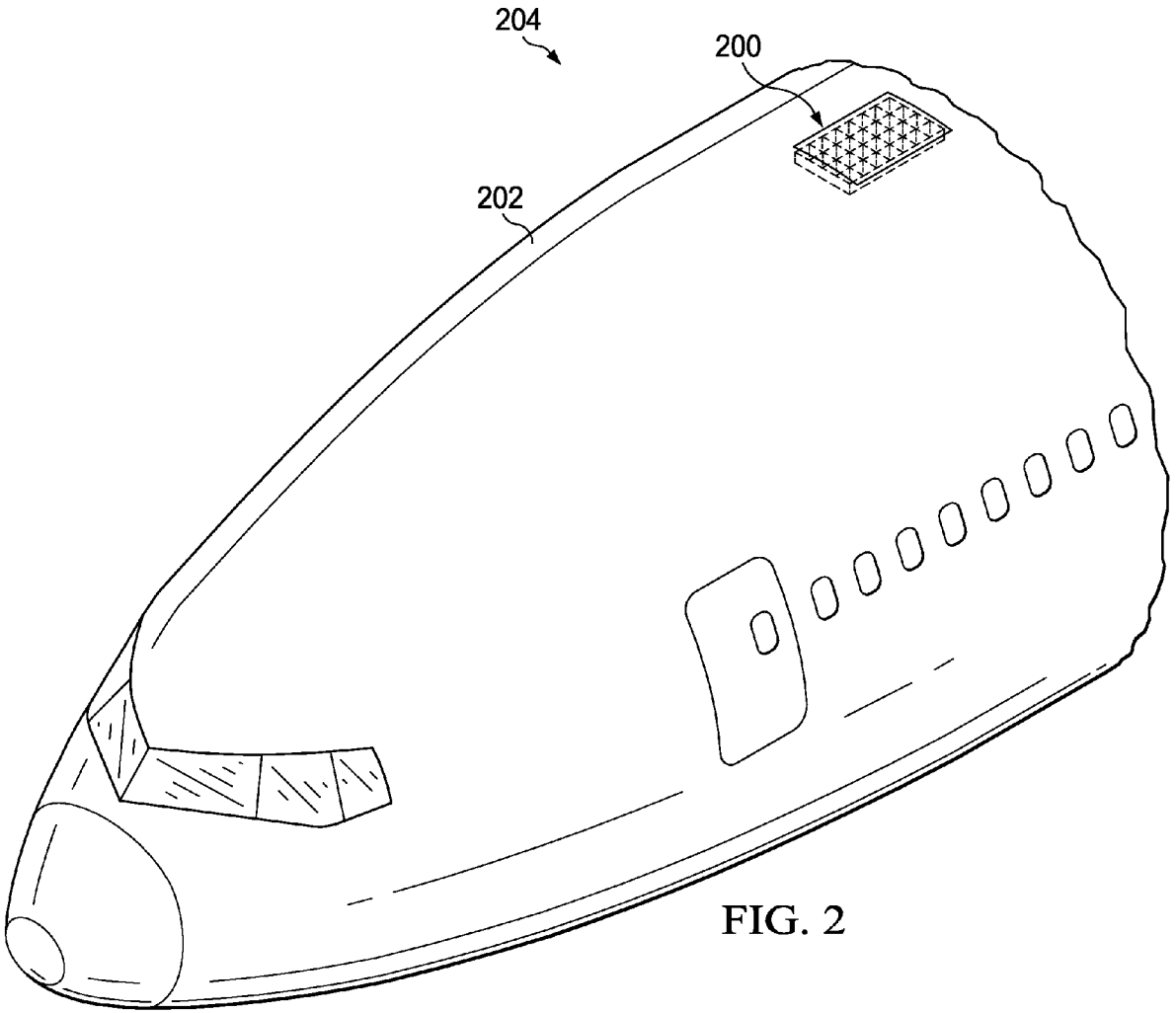
FIG. 2 is an illustration of an antenna aperture integrated into a portion of the fuselage of an aircraft in accordance with an illustrative embodiment.

Turning now to FIG. 2, an illustration of an antenna aperture integrated into a portion of the fuselage of an aircraft is depicted in accordance with an illustrative embodiment. In this example, antenna aperture 200 is an example of one implementation of antenna aperture 100 in FIG. 1. Antenna aperture 200 is integrated into fuselage 202 of aircraft 204. Antenna aperture 200 may be a load bearing portion of fuselage 202. An antenna aperture in accordance with an illustrative embodiment also may be integrated into, or otherwise applied to, wings, stabilizers, flaps, slats, doors, or other structures on an aircraft.

Antenna aperture 200 may incur various inconsistencies while aircraft 204 is in operation. For example, without limitation, such inconsistencies may result from the impact of debris or other objects on fuselage 202 in the area near antenna aperture 200 while aircraft 204 is in operation. In other cases, inconsistencies may be caused by excessive heat, lightning strikes, handling equipment in the area near antenna aperture 200, or other causes or combinations of causes. Such inconsistencies may affect the performance of antenna aperture 200 in undesired ways. For example, such inconsistencies may affect the radio frequency performance of antenna aperture 200, the structural performance of antenna aperture 200, or both.

Figure 3:
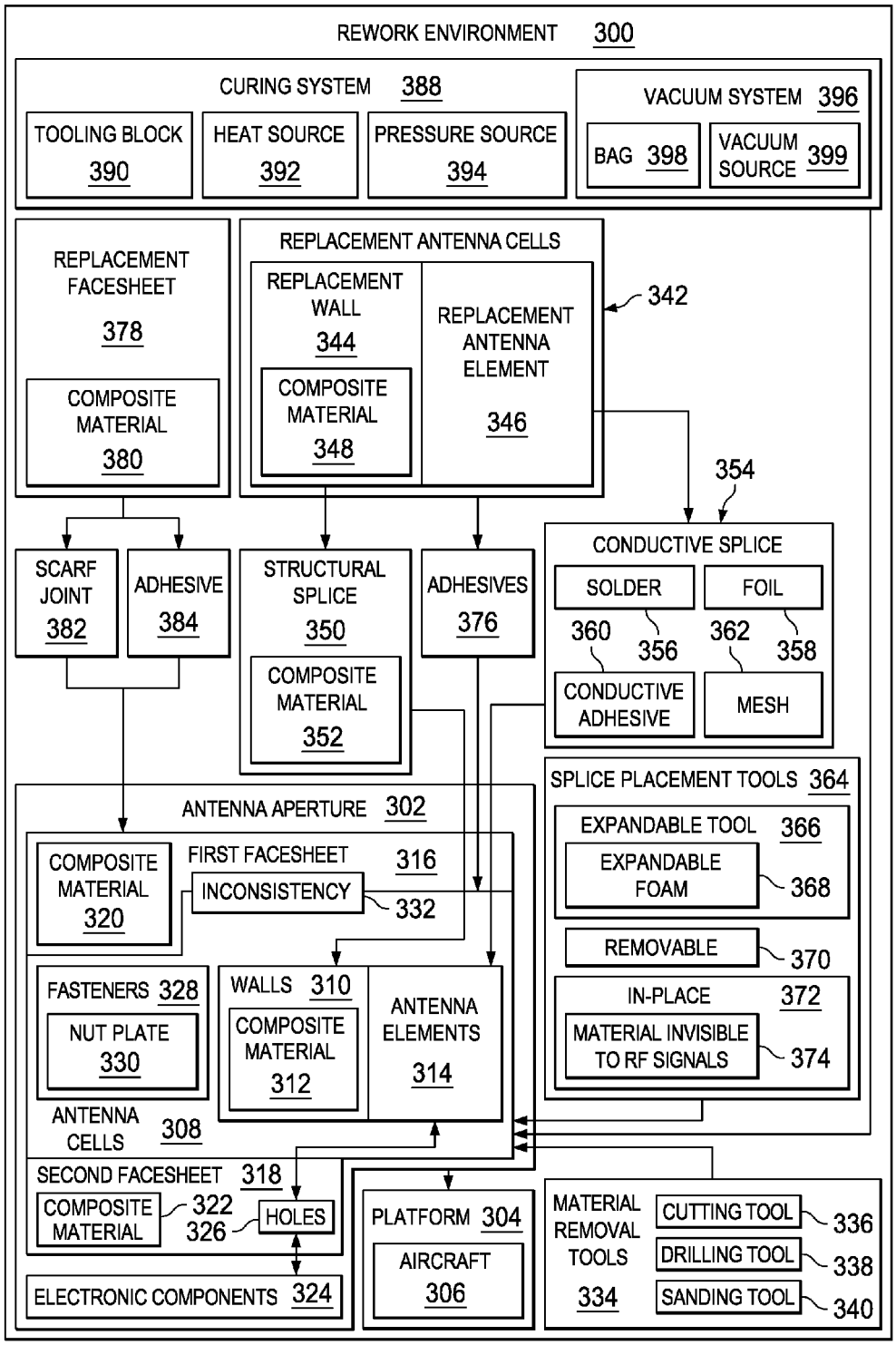
FIG. 3 is an illustration of a block diagram of a rework environment in accordance with an illustrative embodiment.

Turning now to FIG. 3, an illustration of a block diagram of a rework environment is depicted in accordance with an illustrative embodiment. Rework environment 300 in FIG. 3 may be used during manufacturing or maintenance of any vehicle or other platform or during manufacturing or maintenance of a part for the vehicle or other platform. For example, without limitation, rework environment 300 may be used during manufacturing or maintenance of aerospace vehicle 1400 in FIG. 14, or during manufacturing or maintenance of a part for aerospace vehicle 1400.

Rework environment 300 may be configured for reworking antenna aperture 302. In this example, antenna aperture 302 is an example of one implementation of antenna aperture 100 in FIG. 1 and antenna aperture 200 in FIG. 2. For example, without limitation, antenna aperture 302 may be configured for use on platform 304. For example, without limitation, platform 304 may be aircraft 306 or another type of vehicle or other type of fixed or moveable platform.

Antenna aperture 302 may include antenna cells 308. Antenna cells 308 may be defined by walls 310 formed in a grid-like pattern. Walls 310 may be made of composite material 312. For example, without limitation, composite material 312 may include fibers and resins. The fibers and resins may be combined and cured to form walls 310 made of composite material 312.

Antenna elements 314 may be attached to walls 310. For example, without limitation, antenna elements 314 may be attached to walls 310 using an appropriate adhesive or in another appropriate manner. Antenna elements 314 are made of a conductive material. The shape of antenna elements 314 and the arrangement of antenna elements 314 on walls 310 may be selected based on the desired performance characteristics of the phased array antenna or other system in which antenna aperture 302 is used.

Antenna cells 308 may be enclosed on a first side by first facesheet 316 and on a second side by second facesheet 318. For example, first facesheet 316 may be attached to a first edge surface of walls 310 on a first side of antenna cells 308 and second facesheet 318 may be attached to a second edge surface of walls 310 on a second side of antenna cells 308. For example, without limitation, first facesheet 316 may be made of composite material 320 and second facesheet 318 may be made of composite material 322.

Antenna elements 314 may be connected to various electronic components 324. For example, electronic components 324 may be configured for transmitting radio frequency signals via antenna elements 314, for receiving radio frequency signals via antenna elements 314, or both. Electronic components 324 may be part of antenna aperture 302 or separate from but connected to antenna aperture 302. For example, without limitation, electronic components 324 may be attached to or form part of second facesheet 318. Electronic components 324 may be connected to antenna elements 314 via holes 326 extending through second facesheet 318.

Antenna aperture 302 may be attached to a support structure or other structure using fasteners 328. In some cases, fasteners 328 may extend through second facesheet 318 into a number of antenna cells 308. For example, without limitation, fasteners 328 may include nut plate 330 in a number of antenna cells 308.

Antenna aperture 302 may incur inconsistency 332. For example, without limitation, inconsistency 332 may include a dent, crack, gouge, or other inconsistency in a portion of antenna aperture 302. For example, without limitation, inconsistency 332 may affect a portion of first facesheet 316 and a number of antenna cells 308. In another example, inconsistency 332 may also affect second facesheet 318.

For example, without limitation, inconsistency 332 may be caused by the impact of debris or other objects on antenna aperture 302 or by other causes while antenna aperture 302 is in use, such as while antenna aperture 302 is in use on platform 304 such as aircraft 306. As another example, inconsistency 332 may be caused during manufacture, transportation, or storage of antenna aperture 302 or while antenna aperture 302 is being installed or inspected.

In any case, inconsistency 332 may affect the performance of antenna aperture 302 in undesired ways. For example, inconsistency 332 may affect the structural performance of antenna aperture 302 or the radio frequency performance of antenna aperture 302. In many cases, both the structural performance and the radio frequency performance of antenna aperture 302 may be affected in undesired ways by inconsistency 332.

In accordance with an illustrative embodiment, antenna aperture 302 may be reworked to remove inconsistency 332 and to restore both the radio frequency performance and structural performance of antenna aperture 302. Reworking of antenna aperture 302 may begin by removing portions of antenna aperture 302 including inconsistency 332. This may include, for example, removing a portion of first facesheet 316 and a portion of antenna cells 308 that may be affected by inconsistency 332. A portion of second facesheet 318 that may be affected by inconsistency 332 also may be removed. Removing a portion of antenna cells 308 affected by inconsistency 332 may include cutting through and removing a number of walls 310 including antenna elements 314 attached thereto.

Portions of antenna aperture 302 with inconsistency 332 may be removed using various material removal tools 334. Material removal tools 334 may include any tools that are appropriate for cutting through or otherwise removing composite materials. For example, without limitation, material removal tools 334 may include cutting tool 336, drilling tool 338, and sanding tool 340.

Cutting tool 336 may include any appropriate tool for cutting through composite materials. For example, without limitation, cutting tool 336 may include a router or other powered tool for cutting through first facesheet 316 and walls 310 of antenna cells 308. As another example, cutting tool 336 may include hand-operated shears for cutting through walls 310 of antenna cells 308 after a portion of first facesheet 316 has been removed from antenna aperture 302. In any case, cutting tool 336 may include a depth guide or similar structure for controlling or limiting the depth of cut into walls 310. For example, it may be desirable that walls 310 are cut through from the edge of walls 310 that was in contact with the removed portion of first facesheet 316 to the edge of walls 310 that is attached to second facesheet 318. In this case, it is desirable that a depth guide or other appropriate structure on cutting tool 336 is set to prevent cutting into second facesheet 318. After cutting through walls 310 using cutting tool 336, walls 310 with inconsistency 332 may be removed from antenna aperture 302 using pliers or another hand-held tool or other tools.

Drilling tool 338 may include a drill or other tool for removing material from holes 326 in second facesheet 318. For example, after removing walls 310 from antenna aperture 302, conductive adhesive or other debris may remain in holes 326 for connecting electronic components 324 to antenna elements 314 on walls 310 that were removed. This material may be removed using drilling tool 338 to clear holes 326.

Sanding tool 340 may be used to prepare the cut edges of walls 310 remaining in antenna aperture 302 and other surfaces of antenna aperture 302 where antenna cells 308 have been removed to prepare such surfaces for the placement of replacement antenna cells 342. For example, without limitation, sanding tool 340 may include a rotary sander, a sand blaster, or other similar tool for removing materials such as adhesive residue from the areas in antenna aperture 302 from which antenna cells 308 with inconsistency 332 have been removed.

Replacement antenna cells 342 then may be placed in antenna aperture 302 in place of the number of antenna cells 308 that were removed and adjacent to remaining antenna cells 308 in antenna aperture 302. Replacement antenna cells 342 may include replacement wall 344 with replacement antenna element 346 thereon. Replacement wall 344 may be made of composite material 348. Replacement antenna element 346 may be made of a conductive material and may have the same shape as one of antenna elements 314, or as a portion of one of antenna elements 314, that was removed from antenna aperture 302. Replacement antenna element 346 may be attached to replacement wall 344 using an appropriate adhesive or in another appropriate manner. The process used to form replacement antenna cells 342 may be similar to or different from the process originally used to form antenna cells 308 in antenna aperture 302.

Replacement antenna cells 342 may be placed in antenna aperture 302 such that replacement wall 344 abuts a cut edge of one of walls 310 remaining in antenna aperture 302. Replacement wall 344 may then be joined to one of walls 310 by structural splice 350. Structural splice 350 may be a piece of structural material that is attached to both replacement wall 344 and an adjacent one of walls 310 remaining in antenna aperture 302 to form a joint between replacement wall 344 and the one of walls 310. For example, without limitation, structural splice 350 may be made of composite material 352. Structural splice 250 may be attached to replacement wall 344 and one of walls 310 using an appropriate adhesive. Structural splice 350 may be used to form a number of structural joints between replacement antenna cells 342 and remaining walls 310 in antenna aperture 302. Structural splice 350 may be used to restore the structural performance of antenna aperture 302.

Replacement antenna element 346 on replacement wall 344 may be connected using conductive splice 354 to a remaining one of antenna elements 314 on one of walls 310 attached to replacement wall 344. Conductive splice 354 may be made of any appropriate conductive material. For example, conductive splice 354 may be made of solder 356, foil 358, conductive adhesive 360, mesh 362, or any other appropriate form of conductive material or combination of such materials. For example, without limitation, solder 356 may be a low temperature conductive solder.

Conductive splice 354 may be formed of foil 358 made of copper, or another appropriate material, in combination with solder 356. Conductive splice 354 may be formed using conductive adhesive 360 alone, or conductive adhesive 360 in combination with foil 358 made of copper or another appropriate material. Mesh 362 made of copper, or another appropriate material, may be used in combination with conductive adhesive 360, a non-conductive adhesive, or both to form conductive splice 354.

A surface preparation, such as a light hand abrasion with sand paper, may be used to activate the bonding surface of any existing conductive adhesive on replacement antenna element 346 and the one of antenna elements 314 to which conductive splice 354 is to be attached. Conductive splice 354 is preferably shaped to match the shape of the portions of replacement antenna element 346 and the one of antenna elements 314 remaining in antenna aperture 302 to which conductive splice 354 is to be attached. By using such a shape for conductive splice 354, the likelihood that conductive splice 354 will affect the radio frequency performance of the reworked antenna aperture 302 in any undesired way is reduced.

Conductive splice 354 may be used at each location where replacement antenna element 346 in replacement antenna cells 342 is to be connected to adjacent antenna elements 314 remaining in antenna aperture 302. The use of replacement antenna element 346 in combination with conductive splice 354 in this manner may restore the radio frequency performance of antenna aperture 302.

In one example, without limitation, structural splice 350 and conductive splice 354 may be positioned on opposite sides of replacement wall 344 and one of walls 310 to which structural splice 350 and conductive splice 354 are attached. For example, without limitation, replacement antenna element 346 may be on one side of replacement wall 344 and the one of antenna elements 314 may be on one side of the one of walls 310 to which replacement wall 344 will be joined by structural splice 350. In this case, conductive splice 354 may be attached to replacement antenna element 346 and the one of antenna elements 314 on one side of replacement wall 344 and the one of walls 310, respectively. Structural splice 350 may be placed on the opposite side of replacement wall 344 and the one of walls 310 from conductive splice 354. In another example, structural splice 350 and conductive splice 354 may be positioned on the same side of replacement wall 344 and the one of walls 310.

Structural splice 350 and conductive splice 354 may be placed in position after replacement antenna cells 342 are placed into antenna aperture 302 to restore the basic cell structure of antenna aperture 302. Various splice placement tools 364 may be used to place structural splice 350, conductive splice 354, or both in the appropriate positions in the cell structure. For example, without limitation, splice placement tools 364 may include expandable tool 366. For example, without limitation, expandable tool 366 may include a block of expandable foam 368 or other appropriate expandable materials. Structural splice 350, conductive splice 354 or both may be placed on expandable tool 366. Expandable tool 366 with structural splice 350, conductive splice 354, or both thereon then may be placed in an antenna cell formed between replacement antenna cells 342 and remaining antenna cells 308 in antenna aperture 302 to place structural splice 350, conductive splice 354, or both, in the desired position. In this case, the antenna cell formed between replacement antenna cells 342 and antenna cells 308 may include a space adjacent to where replacement wall 344 is to be joined to one of walls 310 of antenna cells 308. Expandable tool 366 with structural splice 350, conductive splice 354, or both thereon may be positioned in this space. Expandable tool 366 then may be expanded to press structural splice 350 into the desired position against replacement wall 344 and one of walls 310, to press conductive splice 354 into the desired position against replacement antenna element 346 and one of antenna elements 314, or both.

Splice placement tools 364 may be removable 370. For example, splice placement tools 364 used to position structural splice 350, conductive splice 354, or both in antenna aperture 302 may remain in position in antenna aperture 302 during curing, to be discussed in more detail below. After curing, removable 370 splice placement tools 364 may be removed from antenna aperture 302.

Alternatively, splice placement tools 364 may remain in place 372 in antenna aperture 302 after curing. In this case, in place 372 splice placement tools 364 may be made of material invisible to radio frequency (RF) signals 374. For example, without limitation, in place 372 splice placement tools 364 may be made of a foam or other solid material invisible to radio frequency (RF) signals 374. Material invisible to radio frequency signals 374 may include any material that does not substantially absorb or reflect radio frequency signals. In particular, material invisible to radio frequency signals 374 may include any material that does not substantially reflect or absorb radio frequency or other signals over a range of frequencies at which antenna aperture 302 will be operated. In any case, material invisible to radio frequency signals 374 may be selected such that the presence of material invisible to radio frequency signals 374 in antenna aperture 302 does not affect the radio frequency performance of antenna aperture 302 in any undesired way.

In addition to structural splice 350 and conductive splice 354, various adhesives 376 may be used to attach replacement antenna cells 342 into antenna aperture 302. Adhesives 376 may include conductive adhesives, non-conductive adhesives, or both. For example, conductive adhesives may be placed in holes 326 in second facesheet 318 that were exposed when antenna cells 308 with inconsistency 332 were removed from antenna aperture 302. This conductive adhesive is used to provide electrical connectivity between replacement antenna element 346 on replacement antenna cells 342 and electronic components 324 via holes 326. Non-conductive adhesives may be used to bond replacement wall 344, structural splice 350, or both, to antenna aperture 302. For example, without limitation, a piece of adhesive material, or adhesive material in another form, may be placed in replacement antenna cells 342 or antenna cells 308 adjacent to where replacement wall 344 contacts second facesheet 318. Such adhesives may be used to form a bond between replacement wall 344, an adjacent one of walls 310 remaining in antenna cells 308, and second facesheet 318 when cured.

After placing replacement antenna cells 342 in antenna aperture 302, the portion of first facesheet 316 with inconsistency 332 that was removed may be replaced by replacement facesheet 378. For example, replacement facesheet 378 may be made of composite material 380. Replacement facesheet 378 may be attached to the remaining portion of first facesheet 316 to form scarf joint 382 between replacement facesheet 378 and first facesheet 316. Replacement facesheet 378 may be attached to antenna aperture 302 using an appropriate adhesive 384. A portion of second facesheet 318 with inconsistency 332 that may have been removed may be replaced in a similar way.

Curing system 388 may be used to cure the various adhesives and other materials that are used to attach replacement antenna cells 342 and replacement facesheet 378 to antenna aperture 302 to form a cured reworked antenna aperture 302. For example, without limitation, various components of curing system 388 may be used to perform a first curing process after replacement antenna cells 342, structural splice 350, conductive splice 354, and adhesives 376 are placed in antenna aperture 302. Curing system 388 may be used to perform a second curing process after replacement facesheet 378 is attached to antenna aperture 302 with adhesive 384. Alternatively, curing system 388 may be used to perform a single curing process or any other number of curing processes to form a cured reworked antenna aperture 302.

Curing system 388 may include tooling block 390. Tooling block 390 may be configured to be placed in replacement antenna cells 342, antenna cells 308, or both, adjacent to a joint between replacement antenna cells 342 and antenna cells 308. Tooling block 390 may be configured to conduct heat from heat source 392 and pressure from pressure source 394 to the joint to cure adhesives 376 and other materials used to attach replacement antenna cells 342 to antenna aperture 302. For example, without limitation, tooling block 390 may include conductively heated elements embedded therein to apply heat to adhesives 376 in antenna cells 308 or replacement antenna cells 342. In this case, heat may be delivered from heat source 392 to tooling block 390 through a plate or manifold attached to tooling block 390. As another example, tooling block 390 may be wrapped with an inductively heated coil. In this case, heat source 392 may include an induction heater to heat the coil wrapped tooling block 390 to apply heat to adhesives 376 in replacement antenna cells 342 or antenna cells 308. In some cases, tooling block 390 may also be used as one of splice placement tools 364.

In general, heat source 392 may include any appropriate system for raising the temperature of antenna aperture 302 or any portion thereof to an appropriate temperature level and for an appropriate duration for curing. Pressure source 394 may include any appropriate system or structure for providing the appropriate pressure to join parts during curing. Curing system 388 also may include vacuum system 396. Vacuum system 396 may include bag 398 for enclosing the components to be cured and vacuum source 399 for evacuating bag 398 with the components therein to provide appropriate vacuum conditions for curing as will be known to those skilled in the art.

The illustration of FIG. 3 is not meant to imply physical or architectural limitations to the manner in which different illustrative embodiments may be implemented. Other components in addition to, in place of, or both in addition to and in place of the ones illustrated may be used. Some components may be unnecessary in some illustrative embodiments. Also, the blocks are presented to illustrate some functional components. One or more of these blocks may be combined or divided into different blocks when implemented in different illustrative embodiments.

For example, structural splice 350 and conductive splice 354 may be provided by a single structure. For example, conductive splice 354 may be formed of a conductive material in a manner such that the use of conductive splice 354 to connect replacement antenna element 346 in replacement antenna cells 342 to antenna elements 314 in antenna cells 308 also joins replacement wall 344 to one of walls 310 in a manner that restores the structural performance of antenna aperture 302. In this case, conductive splice 354 may perform the functions of both conductive splice 354 and structural splice 350 so that a separate structural splice 350 may not need to be used.

The various composite materials mentioned above may be the same composite materials or different composite materials in various combinations. The specific materials forming antenna aperture 302 and the specific materials used to rework antenna aperture 302 may be selected as appropriate for the particular application of antenna aperture 302. These materials will be known to those skilled in the art of forming structures of composite materials for use in aircraft and other applications and those skilled in the art of repairing such structures made of composite materials.

Figure 4:
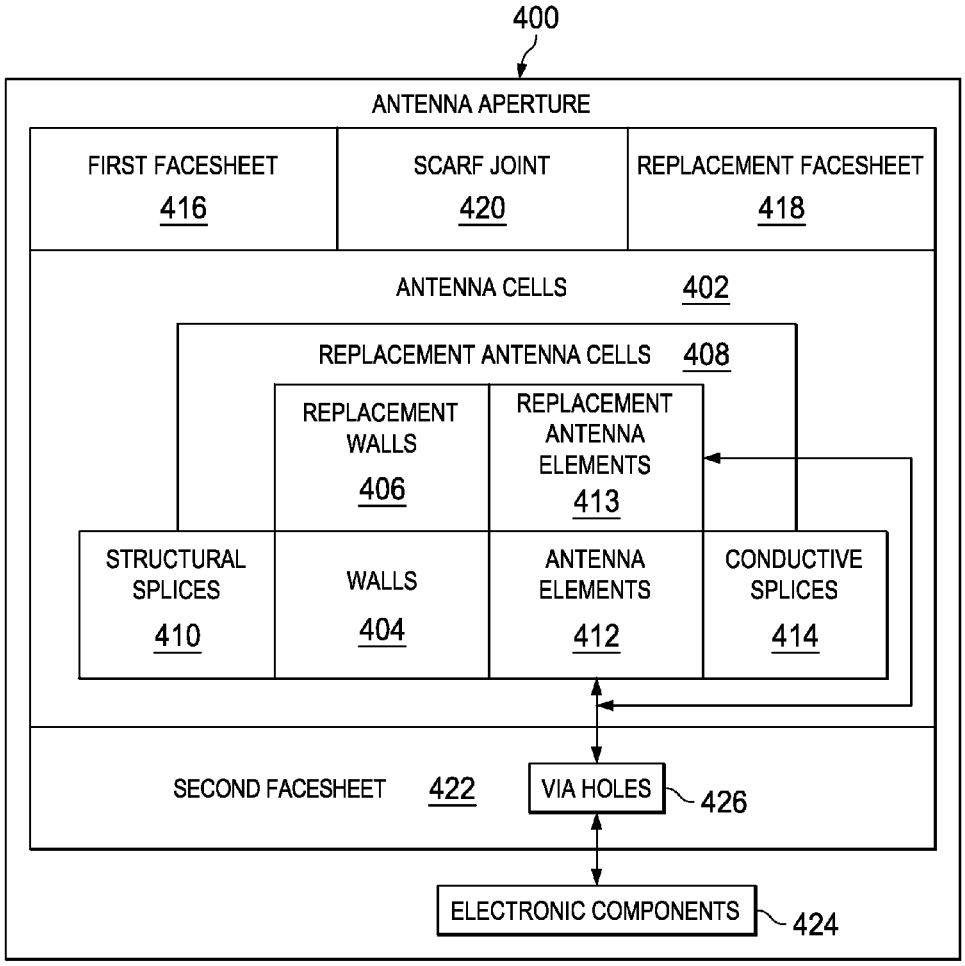
FIG. 4 is an illustration of a block diagram of a reworked antenna aperture in accordance with an illustrative embodiment.

Turning now to FIG. 4, a block diagram of a reworked antenna aperture is depicted in accordance with an illustrative embodiment. In this example, antenna aperture 400 is an example of one implementation of antenna aperture 302 after antenna aperture 302 is reworked to include replacement antenna cells 342 and replacement facesheet 378 in FIG. 3.

Antenna aperture 400 includes antenna cells 402. Antenna cells 402 are defined by walls 404 and replacement walls 406. Walls 404 may be original walls forming antenna cells 402. Replacement walls 406 are part of replacement antenna cells 408. Replacement antenna cells 408 may be placed in antenna aperture 400 to replace antenna cells 402 with inconsistencies that have been removed from antenna aperture 400. Replacement walls 406 may be attached to walls 404 by structural splices 410. Structural splices 410 may form a structural joint between replacement walls 406 and walls 404 to restore the structural performance of antenna aperture 400.

Antenna cells 402 also include antenna elements 412 on walls 404 and replacement antenna elements 413 on replacement walls 406. Antenna elements 412 may include original antenna elements in antenna aperture 400. Replacement antenna elements 413 are part of replacement antenna cells 408. Conductive splices 414 are attached to replacement antenna elements 413 and antenna elements 412. Replacement antenna elements 413 and conductive splices 414 may be shaped such that using replacement antenna elements 413 and conductive splices 414 to rework antenna aperture 400 may restore the radio frequency performance of antenna aperture 400.

First facesheet 416 may be attached to walls 404 of antenna cells 402 on a first side of antenna cells 402. Replacement facesheet 418 may be attached to replacement walls 406 of replacement antenna cells 408 on a first side of replacement antenna cells 408. Replacement facesheet 418 may be attached to first facesheet 416 at scarf joint 420.

Second facesheet 422 may be attached to walls 404 of antenna cells 402 on a second side of antenna cells 402 and to replacement walls 406 of replacement antenna cells 408 on a second side of replacement antenna cells 408. Antenna elements 412 and replacement antenna elements 413 may be connected to electronic components 424 via holes 426 extending through second facesheet 422.

Figure 5:
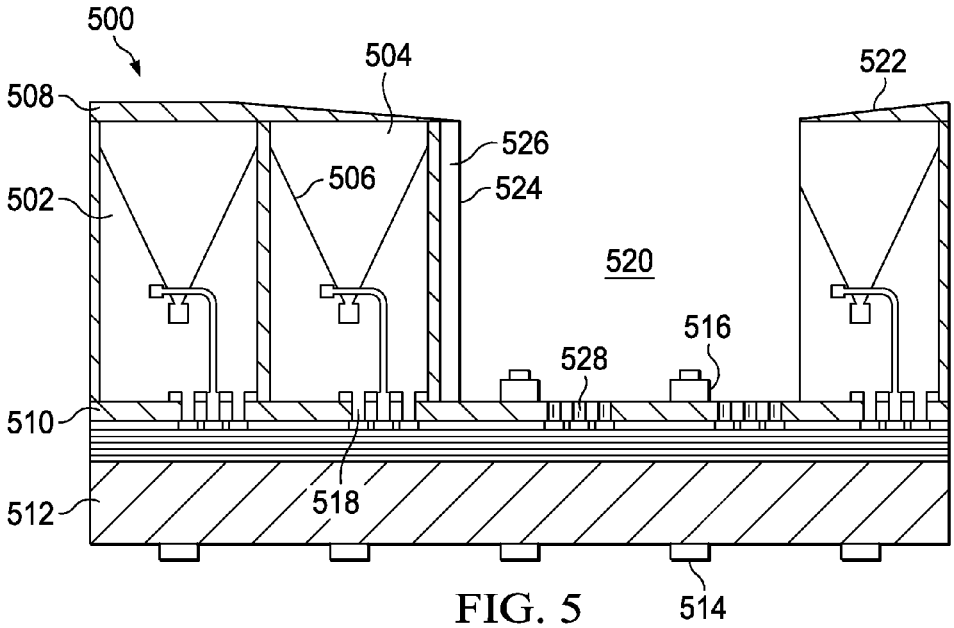
FIG. 5 is an illustration of a cross section of an antenna aperture with a portion removed in accordance with an illustrative embodiment.

Turning now to FIG. 5, an illustration a cross section of an antenna aperture with a portion removed is depicted in accordance with an illustrative embodiment. In this example, antenna aperture 500 is an example of one implementation of antenna aperture 302 in FIG. 3.

Antenna aperture 500 includes antenna cells 502. Antenna cells 502 are formed by walls 504. For example, walls 504 may be arranged to form a grid-like structure for antenna cells 502. Antenna elements 506 are formed on, or otherwise attached to, walls 504. First facesheet 508 is attached to walls 504 on a first side of antenna cells 502. Second facesheet 510 is attached to walls 504 on a second side of antenna cells 502. Thus, in this example, antenna cells 502 are sandwiched between first facesheet 508 and second facesheet 510.

Second facesheet 510 may be attached to support structure 512 using appropriate fasteners 514. In this example, fasteners 514 include nut plates 516 located in antenna cells 502. Support structure 512 may include various electronic components. Antenna elements 506 may be connected to electronic components in support structure 512 via holes 518 extending through second facesheet 510.

In this example, a portion of first facesheet 508 and a number of antenna cells 502 have been removed from antenna aperture 500 in area 520. In this example, a portion of first facesheet 508 adjacent to area 520 has been removed to form one side 522 of a scarf joint.

In this example, antenna cells 502 have been removed from antenna aperture 500 by cutting through walls 504 to form cut edge 524 on flange portion 526 of one of walls 504. Flange portion 526 is a remaining portion of one of walls 504 that was cut through at cut edge 524 to remove antenna cells 502 from antenna aperture 500. Alternatively, antenna cells 502 may be removed from antenna aperture 500 such that a cut edge of a removed one of walls 504 is substantially flush with another one of walls 504.

In this example, holes 528 through second facesheet 510 in area 520 from which antenna cells 502 have been removed have been cleared of residual adhesives and other debris.

Figure 6:
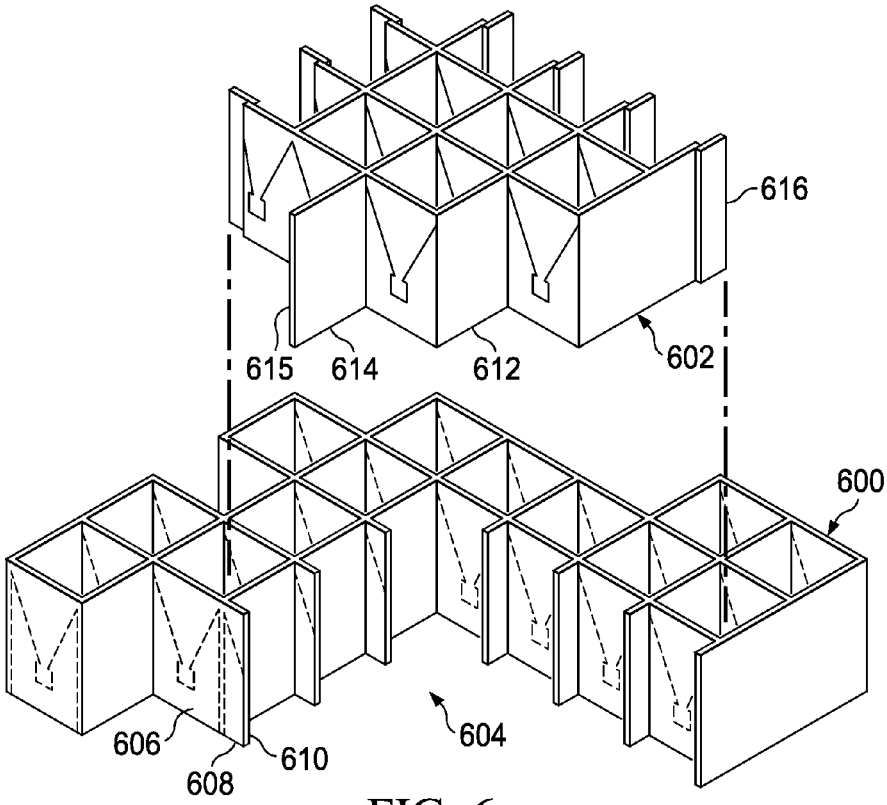
FIG. 6 is an illustration of an antenna aperture with a portion removed and of replacement antenna cells for the antenna aperture in accordance with an illustrative embodiment.

Turning now to FIG. 6, an illustration of an antenna aperture with a portion removed and of replacement antenna cells for the antenna aperture is depicted in accordance with an illustrative embodiment. In this example, antenna aperture 600, with a portion thereof removed, is an example of one implementation of antenna aperture 302 in FIG. 3. In this example, replacement antenna cells 602 is an example of one implementation of replacement antenna cells 342 in FIG. 3. No facesheets or other structures of an antenna aperture are shown in this figure for ease of illustration and explanation.

In this example, antenna cells have been removed from antenna aperture 600 in area 604. The antenna cells have been removed from antenna aperture 600 by cutting through walls 606 of antenna aperture 600 leaving flanges 608 of walls 606 with cut edges 610.

Replacement antenna cells 602 include walls 612. Walls 612 of replacement antenna cells 602 include wall flanges 614 with edges 615. In accordance with an illustrative embodiment, replacement antenna cells 602 may be placed in area 604 of antenna aperture 600 from which antenna cells were removed such that edges 615 of flanges 614 of walls 612 in replacement antenna cells 602 abut cut edges 610 of flanges 608 of walls 606 in antenna aperture 600. In this example, structural splices 616 are attached to flanges 614 of walls 612 in replacement antenna cells 602 before replacement antenna cells 602 are placed in antenna aperture 600 adjacent to the remaining antenna cells in antenna aperture 600.

Figure 7:
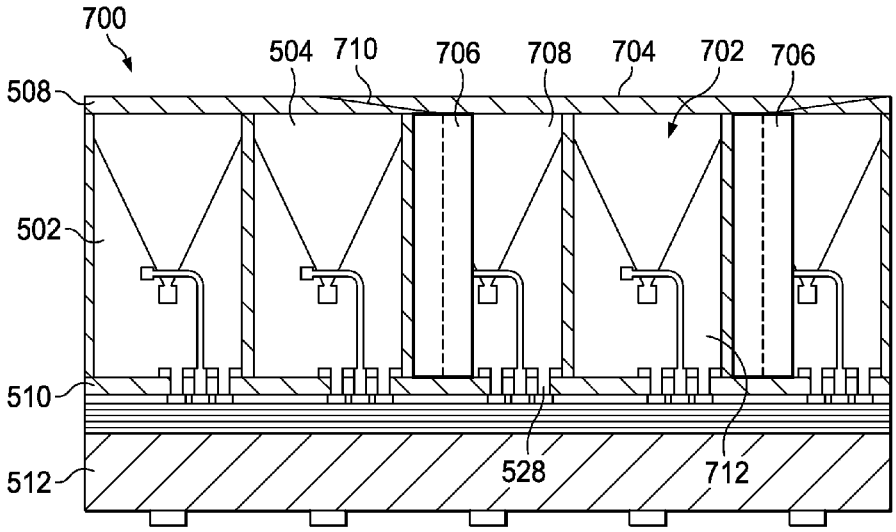
FIG. 7 is an illustration of a cross section of a reworked antenna aperture with replacement antenna cells and structural splices in accordance with an illustrative embodiment.

Turning now to FIG. 7, an illustration of a cross section of a reworked antenna aperture with replacement antenna cells and structural splices is depicted in accordance with an illustrative embodiment. In this example, reworked antenna aperture 700 is an example of one implementation of antenna aperture 500 in FIG. 5 with replacement antenna cells 702 and replacement facesheet 704 attached thereto.

Replacement antenna cells 702 have been placed in area 520 of antenna aperture 500 in FIG. 5 from which antenna cells were removed from antenna aperture 500. Structural splice 706 is attached to a remaining one of walls 504 of antenna cells 502 in FIG. 5 that were not removed from antenna aperture 700 and to replacement wall 708 of replacement antenna cells 702 to form a joint between the one of walls 504 and replacement wall 708. Replacement facesheet 704 is attached to first facesheet 508 of antenna aperture 700 at scarf joint 710.

Replacement antenna elements 712 in replacement antenna cells 702 may be connected to electronic components in support structure 512 via holes 528 through second facesheet 510. For example, replacement antenna elements 712 may be connected to electronic components in support structure 512 via a conductive adhesive in holes 528.

Figure 8:
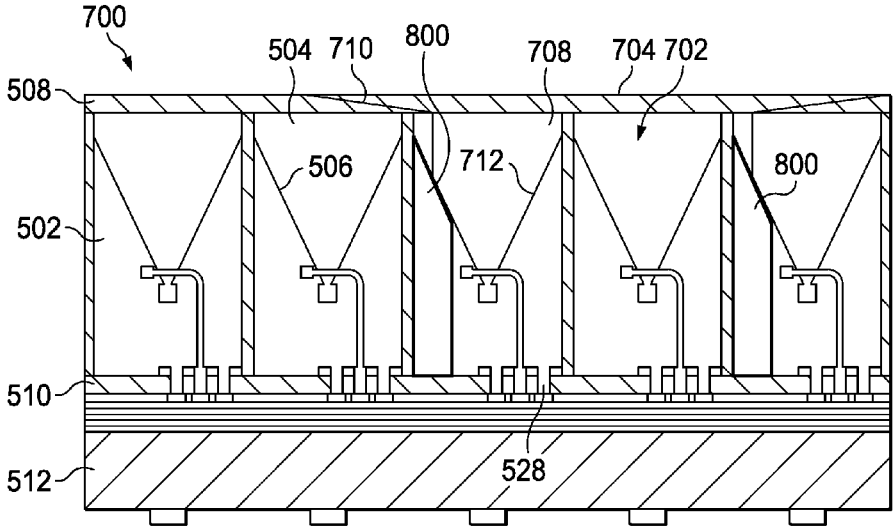
FIG. 8 is an illustration of a cross section of a reworked antenna aperture with replacement antenna cells and conductive splices in accordance with an illustrative embodiment.

Turning now to FIG. 8, an illustration of a cross section of a reworked antenna aperture with replacement antenna cells and conductive splices is depicted in accordance with an illustrative embodiment. In this example, conductive splices 800 connect replacement antenna elements 712 in replacement antenna cells 702 to remaining portions of antenna elements 506 in antenna aperture 700 in FIG. 7 that were not removed from antenna aperture 700. Note that the shape of conductive splices 800 matches the shape of a portion of replacement antenna elements 712 and the shape of a portion of antenna elements 506 to which conductive splices 800 are attached to restore the radio frequency performance of antenna aperture 700.

Figure 9:
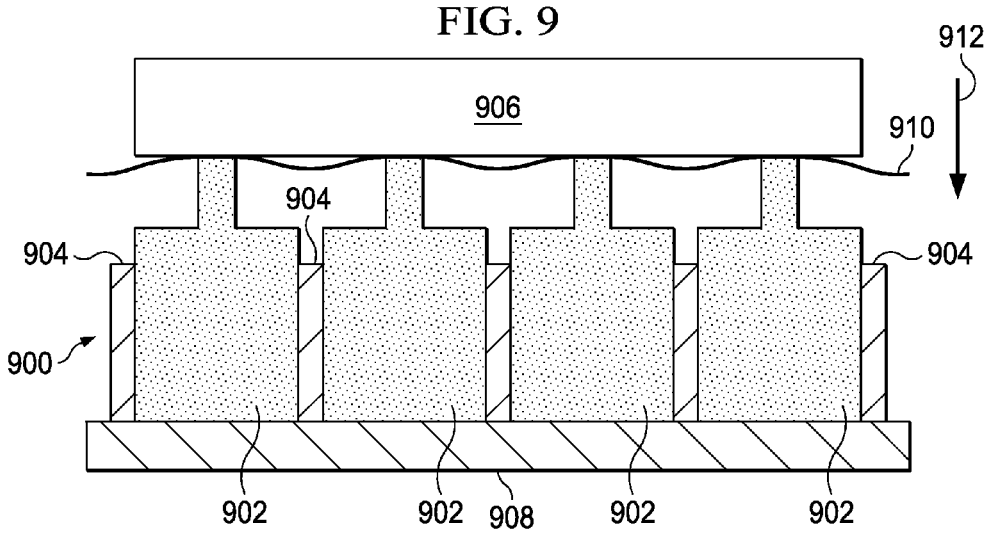
FIG. 9 is an illustration of a cross section of a reworked antenna aperture during curing in accordance with an illustrative embodiment.

Turning now to FIG. 9, an illustration of a cross section of a reworked antenna aperture during curing is depicted in accordance with an illustrative embodiment. In this example, antenna aperture 900 is an example of one implementation of antenna aperture 302 in FIG. 3 after replacement antenna cells 342 have been placed in antenna aperture 302, but before replacement facesheet 378 has been placed on antenna aperture 302.

During curing, tooling blocks 902 may be positioned in the spaces adjacent to walls 904 of antenna cells to be cured. Tooling blocks 902 may be configured to direct heat from heat source 906 to cure adhesives in the antenna cells formed by walls 904. These adhesives may be used, for example, to bond walls 904 to facesheet 908. During curing, antenna aperture 900 may be enclosed in bag 910 forming part of a vacuum bag system. Pressure may be applied in the direction indicated by arrow 912 during the curing process.

Figure 10:
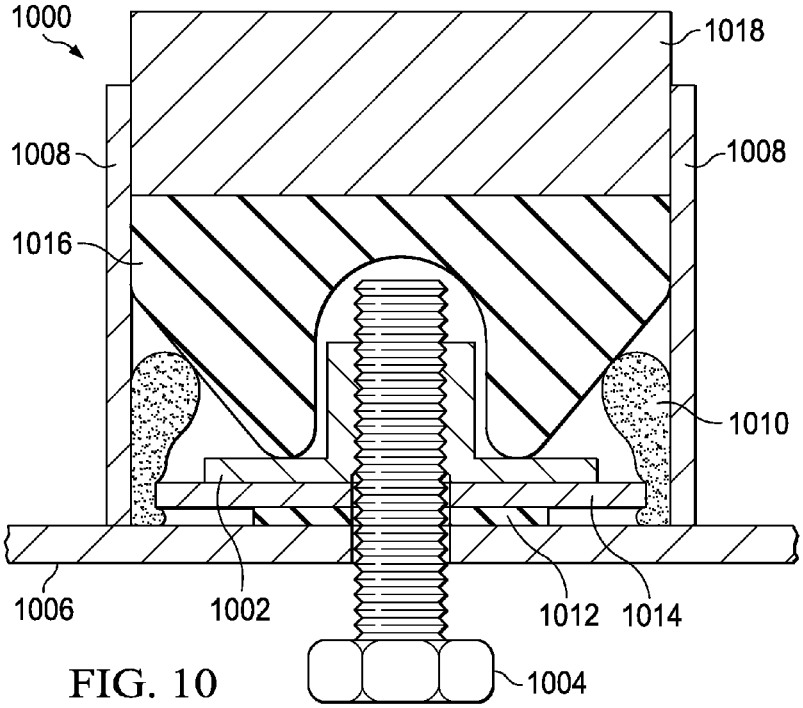
FIG. 10 is an illustration of a cross section of a tooling block in a reworked antenna aperture before curing in accordance with an illustrative embodiment.

Turning now to FIG. 10, an illustration of a cross section of a tooling block in a reworked antenna aperture before curing is depicted in accordance with an illustrative embodiment. In this example, antenna cell 1000 may be part of an antenna aperture that may be attached to a support structure using a fastener including nut plate 1002 and bolt 1004. Bolt 1004 may extend through facesheet 1006 into antenna cell 1000 defined by walls 1008. The end of bolt 1004 is threaded on nut plate 1002 in antenna cell 1000.

Adhesive 1010 may be placed in antenna cell 1000. For example, without limitation, adhesive 1010 may be placed in antenna cell 1000 to bond walls 1008 to facesheet 1006 when adhesive 1010 is cured. In this case, it is desirable to prevent adhesive 1010 from running into contact with nut plate 1002 or bolt 1004 when adhesive 1010 is cured. Any adhesive around nut plate 1002 or bolt 1004 may limit the ability to remove bolt 1004 from nut plate 1002.

In accordance with an illustrative embodiment, seal 1012 may be positioned between facesheet 1006 and base 1014 for nut plate 1002 to prevent a flow of adhesive 1010 towards bolt 1004 during curing. For example, without limitation, seal 1012 may be a sealing gasket that is placed around bolt 1004 between facesheet 1006 and base 1014 for nut plate 1002.

Flexible sealing gasket 1016 may be attached to tooling block 1018 that is positioned in antenna cell 1000 during curing. As shown, flexible sealing gasket 1016 may be configured to fit around nut plate 1002 to separate adhesive 1010 from nut plate 1002 and bolt 1004 when flexible sealing gasket 1016 is compressed.

Figure 11:
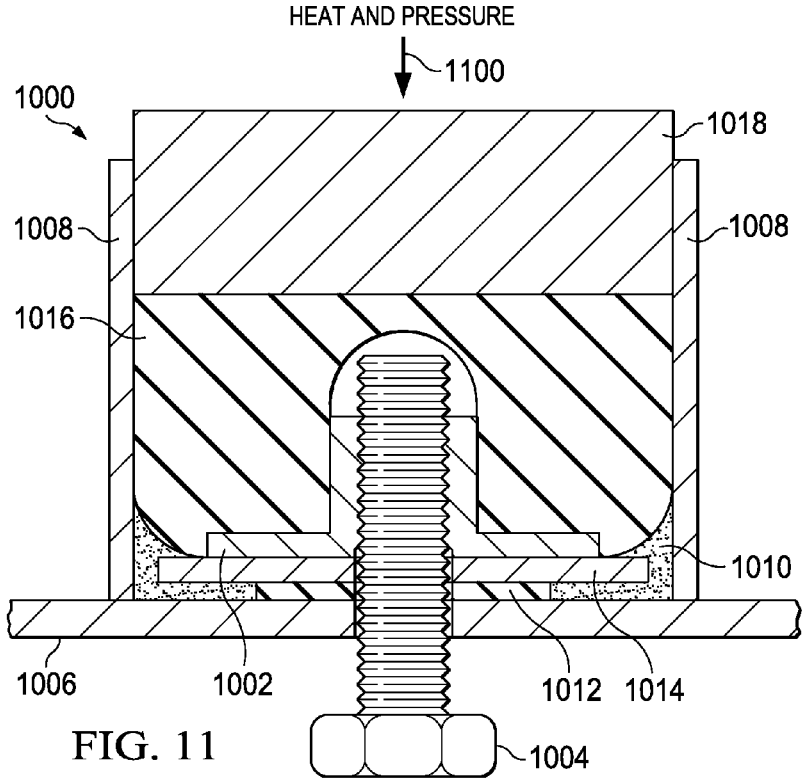
FIG. 11 is an illustration of a cross section of a tooling block in a reworked antenna aperture during curing in accordance with an illustrative embodiment.

Turning now to FIG. 11, an illustration of a cross section of a tooling block in a reworked antenna aperture during curing is depicted in accordance with an illustrative embodiment. FIG. 11 shows antenna cell 1000 and tooling block 1018 in FIG. 10 during curing.

During curing, heat and pressure 1100 may be applied to tooling block 1018. The pressure applied to tooling block 1018 compresses flexible sealing gasket 1016 on the end of tooling block 1018 against nut plate 1002 and base 1014 to form a seal that, in combination with seal 1012, prevents the flow of adhesive 1010 to nut plate 1002 and bolt 1004.

The different components shown in FIGS. 5-11 may be combined with components in FIG. 3, used with components in FIG. 3, or a combination of the two. Additionally, some of the components in FIGS. 5-11 may be illustrative examples of how components shown in block form in FIG. 3 or in FIG. 4 may be implemented as physical structures. The structures shown in FIGS. 5-11 are conceptual representations of structures in accordance with various illustrative embodiments. The structures shown in FIGS. 5-11 are provided to illustrate the relationships between component parts of structures in accordance with illustrative embodiments. The structures shown in FIGS. 5-11 may not illustrate actual physical structures or components.

Figure 12:
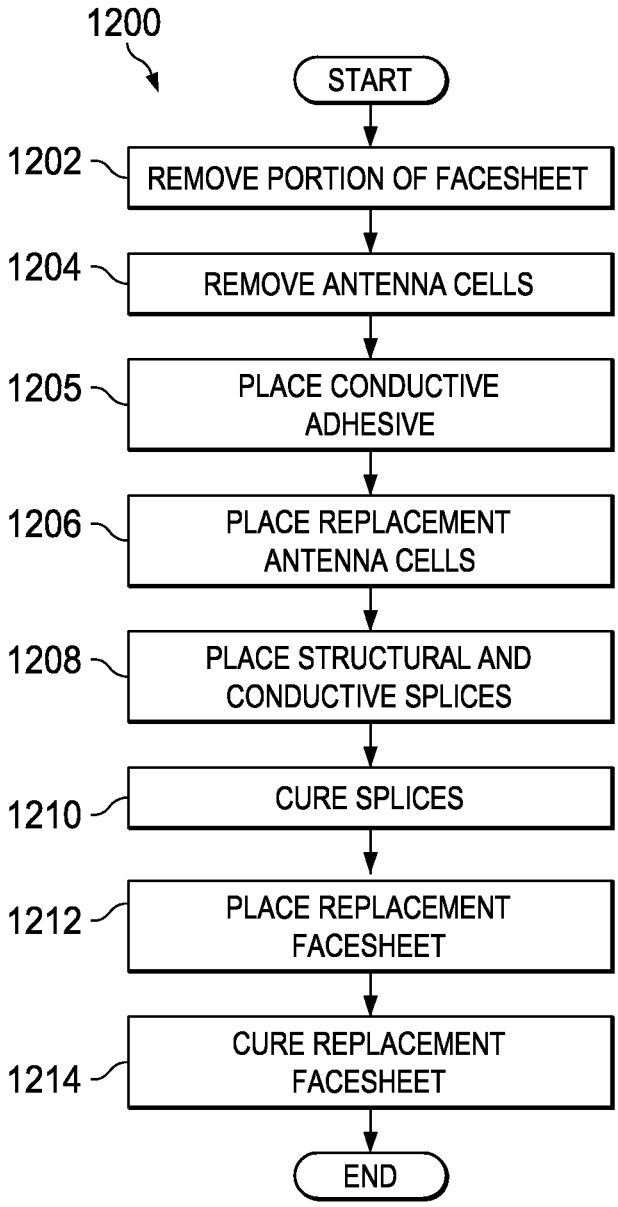
FIG. 12 is an illustration of a flowchart of a process for reworking an antenna aperture array structure in accordance with an illustrative embodiment.

Turning now to FIG. 12, an illustration of a flowchart of a process for reworking an antenna aperture array structure is depicted in accordance with an illustrative embodiment. In this example, the process of FIG. 12 may be implemented in rework environment 300 to rework antenna aperture 302 in FIG. 3.

The process begins by removing a portion of a facesheet of the antenna aperture (operation 1202). For example, operation 1202 may include removing a portion of the facesheet that includes an inconsistency. Antenna cells then may be removed from the antenna aperture (operation 1204). For example, operation 1204 may include cutting through walls forming the antenna cells in the antenna aperture and removing the walls to thereby remove antenna cells that may have inconsistencies. Operation 1204 also may include clearing holes in a second facesheet through which antenna elements on the removed walls were connected to electronic components.

A conductive adhesive may be placed in the holes in the second facesheet (operation 1205). Replacement antenna cells then may be placed in the area of the antenna aperture from which the antenna cells with inconsistencies were removed (operation 1206). Replacement antenna elements in the replacement antenna cells may be connected to the electronic components via the conductive adhesive in the holes in the second facesheet. Structural and conductive splices may be placed to attach the replacement antenna cells to the antenna cells in the antenna aperture that were not removed (operation 1208). The splices may be cured in a curing operation (operation 1210).

A replacement facesheet then may be placed over the replacement antenna cells (operation 1212). The replacement facesheet may be joined to the portion of the facesheet on the antenna aperture that was not removed at a scarf joint using an appropriate adhesive. The replacement facesheet then may be cured (operation 1214) to bond the replacement facesheet to the facesheet that was not removed and to the replacement antenna cells, with the process terminating thereafter.

Figure 13:
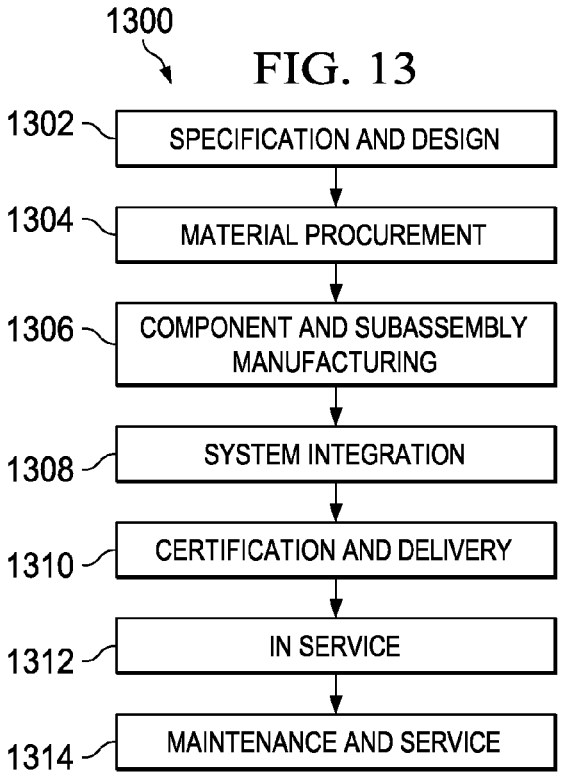
FIG. 13 is an illustration of a block diagram of an aerospace vehicle manufacturing and service method in accordance with an illustrative embodiment.
Figure 14:
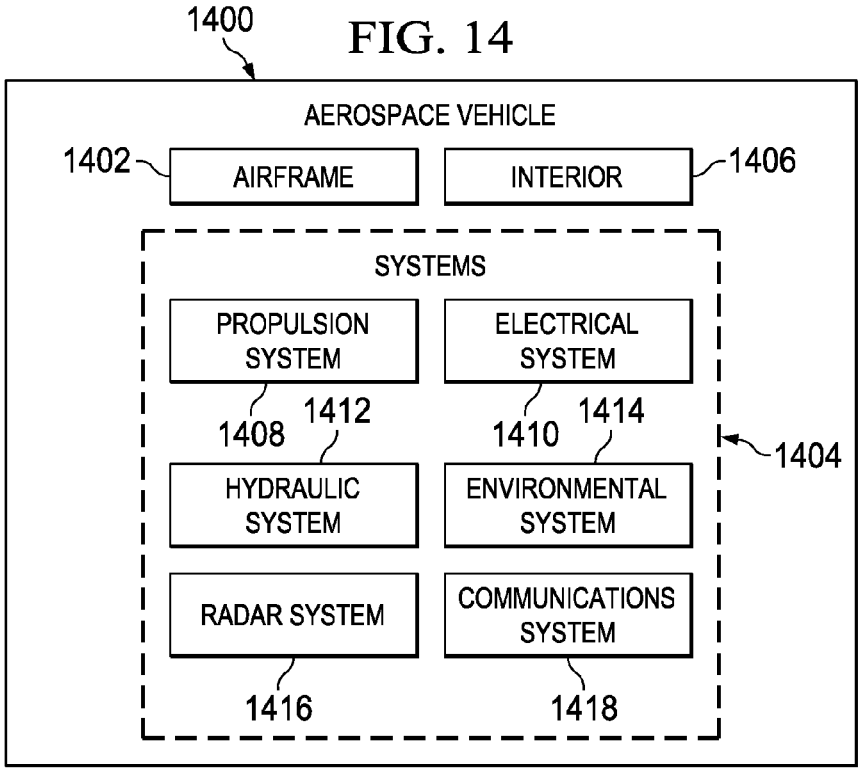
FIG. 14 is an illustration of a block diagram of an aerospace vehicle in which an illustrative embodiment may be implemented.

Embodiments of the disclosure may be described in the context of aerospace vehicle manufacturing and service method 1300 as shown in FIG. 13 and aerospace vehicle 1400 as shown in FIG. 14. Turning first to FIG. 13, an illustration of a block diagram of an aerospace vehicle manufacturing and service method is depicted in accordance with an illustrative embodiment.

During pre-production, aerospace vehicle manufacturing and service method 1300 may include specification and design 1302 of aerospace vehicle 1400 in FIG. 14 and material procurement 1304. During production, component and subassembly manufacturing 1306 and system integration 1308 of aerospace vehicle 1400 in FIG. 14 takes place. Thereafter, aerospace vehicle 1400 in FIG. 14 may go through certification and delivery 1310 in order to be placed in service 1312.

While in service by a customer, aerospace vehicle 1400 in FIG. 14 is scheduled for routine maintenance and service 1314, which may include modification, reconfiguration, refurbishment, and other maintenance or service. In this example, aerospace vehicle manufacturing and service method 1300 is shown as a method for aerospace vehicles, including manned and unmanned aircraft. The different illustrative embodiments may be applied to other types of manufacturing and service methods, including manufacturing and service methods for other types of platforms, including other types of vehicles.

Each of the processes of aerospace vehicle manufacturing and service method 1300 may be performed or carried out by a system integrator, a third party, an operator, or by any combination of such entities. In these examples, the operator may be a customer. For the purposes of this description, a system integrator may include, without limitation, any number of aerospace vehicle manufacturers and major-system subcontractors; a third party may include, without limitation, any number of vendors, subcontractors, and suppliers; and an operator may be a company, a military entity, a service organization, and so on.

With reference now to FIG. 14, an illustration of a block diagram of an aerospace vehicle in which an illustrative embodiment may be implemented is depicted. In this illustrative example, aerospace vehicle 1400 is produced by aerospace vehicle manufacturing and service method 1300 in FIG. 1. Aerospace vehicle 1400 may include an aircraft, a spacecraft, or any other vehicle for traveling through the air, for traveling through space, or which is capable of operation in both air and space. Aerospace vehicle 1400 may include airframe 1402 with plurality of systems 1404 and interior 1406.

Examples of plurality of systems 1404 include one or more of propulsion system 1408, electrical system 1410, hydraulic system 1412, environmental system 1414, radar system 1416, and communications system 1418. Illustrative embodiments may be used to rework components used in plurality of systems 1404. For example, without limitation, illustrative embodiments may be used to rework antenna apertures that may be used in radar system 1416, communications system 1418, or both. Although an aerospace example is shown, different illustrative embodiments may be applied to other industries, such as the automotive industry.

Apparatuses and methods embodied herein may be employed during at least one of the stages of aerospace vehicle manufacturing and service method 1300 in FIG. 13. As used herein, the phrase "at least one of", when used with a list of items, means that different combinations of one or more of the listed items may be used and only one of each item in the list may be needed. For example, "at least one of item A, item B, and item C" may include, for example, without limitation, item A, or item A and item B. This example also may include item A, item B, and item C, or item B and item C.

In one illustrative example, components or subassemblies produced in component and subassembly manufacturing 1306 in FIG. 13 may be fabricated or manufactured in a manner similar to components or subassemblies produced while aerospace vehicle 1400 is in service 1312 in FIG. 13.

As yet another example, a number of apparatus embodiments, method embodiments, or a combination thereof may be utilized during production stages, such as component and subassembly manufacturing 1306 and system integration 1308 in FIG. 13. "A number", when referring to items, means one or more items. For example, "a number of apparatus embodiments" is one or more apparatus embodiments. A number of apparatus embodiments, method embodiments, or a combination thereof may be utilized while aerospace vehicle 1400 is in service 1312, during maintenance and service 1314, or both.

The use of a number of the different illustrative embodiments may substantially expedite the assembly of aerospace vehicle 1400. A number of the different illustrative embodiments may reduce the cost of aerospace vehicle 1400. For example, one or more of the different illustrative embodiments may be used during component and subassembly manufacturing 1306, during system integration 1308, or both. The different illustrative embodiments may be used during these parts of aerospace vehicle manufacturing and service method 1300 to rework antenna array structures that may have undesired inconsistencies.

Further, the different illustrative embodiments also may be implemented during in service 1312, during maintenance and service 1314, or both, to rework inconsistencies that may be discovered in antenna array structures that may be present in aerospace vehicle 1400. By allowing rework rather than replacement, the cost of new parts may be reduced or eliminated. Also, one or more of the different illustrative embodiments may allow for aerospace vehicle 1400 to continue operation with a desired level of performance more quickly as compared to waiting for a replacement part.

The flowcharts and block diagrams in the different depicted embodiments illustrate the structure, functionality, and operation of some possible implementations of apparatuses and methods in different illustrative embodiments. In this regard, each block in the flowcharts or block diagrams may represent a module, segment, function, or a portion of an operation or step. In some alternative implementations, the function or functions noted in the blocks may occur out of the order noted in the figures. For example, in some cases, two blocks shown in succession may be executed substantially concurrently, or the blocks may sometimes be executed in the reverse order, depending upon the functionality involved.

The description of the different illustrative embodiments has been presented for purposes of illustration and description, and is not intended to be exhaustive or to limit the embodiments in the form disclosed. Many modifications and variations will be apparent to those of ordinary skill in the art. Further, different illustrative embodiments may provide different advantages as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus, comprising:

a plurality of antenna cells comprising walls and antenna elements on the walls;

replacement antenna cells adjacent to the plurality of antenna cells, wherein the replacement antenna cells comprise a replacement wall and a replacement antenna element on the replacement wall; and a conductive splice attached to the replacement antenna element and to a one of the antenna elements on a one of the walls.

2. The apparatus of claim 1, wherein the conductive splice comprises a conductive material selected from a solder, a foil, a conductive adhesive, and a mesh.

3. The apparatus of claim 1, wherein a shape of the conductive splice matches a shape of a portion of the replacement antenna element and a shape of a portion of the one of the antenna elements on the one of the walls.

4. The apparatus of claim 1 further comprising a structural splice attached to the replacement wall and to the one of the walls of the plurality of antenna cells.

5. The apparatus of claim 1, wherein the replacement wall is substantially parallel with the one of the walls and an edge of the replacement wall abuts a cut edge of the one of the walls.

6. The apparatus of claim 1 further comprising a solid material substantially invisible to radio frequency signals filling a space adjacent to the replacement wall and the one of the walls.

7. The apparatus of claim 1 further comprising:

a first facesheet attached to the walls on a first side of the plurality of antenna cells; and a replacement facesheet attached to the first facesheet and to the replacement wall on a first side of the replacement antenna cells.

8. The apparatus of claim 7 further comprising:

a second facesheet attached to the walls on a second side of the plurality of antenna cells and to the replacement wall on a second side of the replacement antenna cells; and electronic components connected to the replacement antenna element via a conductive adhesive in a hole in the second facesheet.

9. The apparatus of claim 8 further comprising:

a fastener extending through the second facesheet into a space adjacent to the replacement wall and the one of the walls; and a seal configured to prevent a flow of adhesive into the fastener during curing of the apparatus.

10. The apparatus of claim 1, wherein the apparatus is on an aircraft.

11. An apparatus, comprising:

a plurality of antenna cells comprising walls and antenna elements on the walls;

a first facesheet attached to the walls on a first side of the plurality of antenna cells;

replacement antenna cells adjacent to the plurality of antenna cells, wherein the replacement antenna cells comprise a replacement wall and a replacement antenna element on the replacement wall;

a structural splice attached to the replacement wall and to a one of the walls of the plurality of antenna cells;

a conductive splice attached to the replacement antenna element and to a one of the antenna elements on the one of the walls, wherein a shape of the conductive splice matches a shape of a portion of the replacement antenna element and a shape of a portion of the one of the antenna elements on the one of the walls;

a replacement facesheet attached to the first facesheet and to the replacement wall on a first side of the replacement antenna cells; and a second facesheet attached to the walls on a second side of the plurality of antenna cells and to the replacement wall on a second side of the replacement antenna cells.

12. The apparatus of claim 11, wherein the conductive splice comprises a conductive material selected from a solder, a foil, a conductive adhesive, and a mesh.

13. A method for reworking an antenna aperture, comprising:

removing antenna cells from the antenna aperture, wherein the antenna cells comprise walls and antenna elements on the walls;

placing replacement antenna cells in the antenna aperture in an area from which the antenna cells were removed, wherein the replacement antenna cells comprise a replacement wall and a replacement antenna element on the replacement wall; and placing a conductive splice to connect the replacement antenna element to a one of the antenna elements on a one of the walls.

14. The method of claim 13, wherein removing the antenna cells from the antenna aperture comprises removing the antenna cells with inconsistencies from the antenna aperture.

15. The method of claim 13, wherein removing the antenna cells from the antenna aperture comprises cutting through the walls.

16. The method of claim 15, wherein placing the replacement antenna cells in the antenna aperture comprises placing the replacement wall substantially parallel with the one of the walls and abutting an edge of the replacement wall with a cut edge of the one of the walls.

17. The method of claim 13, wherein the conductive splice comprises a conductive material selected from a solder, a foil, a conductive adhesive, and a mesh.

18. The method of claim 13, wherein a shape of the conductive splice matches a shape of a portion of the replacement antenna element and a shape of a portion of the one of the antenna elements on the one of the walls.

19. The method of claim 13, wherein placing the conductive splice comprises placing an expandable tool in a space adjacent to the replacement wall and the one of the walls.

20. The method of claim 13 further comprising:

placing a structural splice to attach the replacement wall to the one of the walls.

* * * * *